US008820696B1

(12) United States Patent
Wadia

(10) Patent No.: US 8,820,696 B1
(45) **Date of Patent: *Sep. 2, 2014**

(54) PICTURE HANGING DEVICE HAVING A PROTECTIVE CAP

(71) Applicant: Rustam N. Wadia, Charlotte, NC (US)

(72) Inventor: Rustam N. Wadia, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/906,402

(22) Filed: May 31, 2013

(51) Int. Cl.
*A47G 1/24* (2006.01)
*A47G 1/20* (2006.01)
*A47G 1/16* (2006.01)

(52) U.S. Cl.
CPC ..... *A47G 1/1606* (2013.01); *A47G 1/20* (2013.01)
USPC ..... 248/476; 248/489; 248/216.4

(58) Field of Classification Search
CPC ..... A47G 1/20; A47G 1/16; A47G 1/141; A47G 1/162; A47G 1/205
USPC ..... 248/216.1, 217.3, 217.4, 476, 489, 497, 248/498, 544, 546, 547
See application file for complete search history.

(56) References Cited

U.S. PATENT DOCUMENTS

| | | | | |
|---|---|---|---|---|
| 3,599,686 | A * | 8/1971 | Peebles | 81/44 |
| 4,225,108 | A * | 9/1980 | Jaroche | 248/544 |
| 8,308,122 | B1 * | 11/2012 | Wadia | 248/475.1 |
| 2009/0283650 | A1 * | 11/2009 | Yates | 248/220.21 |
| 2010/0219323 | A1 * | 9/2010 | Ernst et al. | 248/475.1 |

FOREIGN PATENT DOCUMENTS

FR 2149609 A5 * 3/1971

* cited by examiner

*Primary Examiner* — Gwendolyn W Baxter
(74) *Attorney, Agent, or Firm* — Seth L. Hudson; Clements Bernard PLLC

(57) ABSTRACT

The present invention provides methods and systems for a picture hanging device for mounting a picture to a retention member engaged to a wall that includes a tube having a top portion and a bottom portion, the bottom portion of the tube is designed to receive a retention member mounted to a wall, the top portion of the tube extends into the air for correctly aligning the picture on the retention member and contains a protective cap, whereby a hanging mechanism engaged to the picture is positioned about the tube and is slid down the tube for engagement to the retention member and the tube is positioned within the center of the picture for correctly aligning the picture on the retention member.

18 Claims, 5 Drawing Sheets

28
26
26
10
18
28
26

18

10
16
12
16
20
14
20

14
12

PICTURE HANGING DEVICE HAVING A PROTECTIVE CAP

FIELD OF THE INVENTION

The present invention relates generally to a picture hanging device, and more specifically relates to a device for accurately and precisely positioning a picture, mirror, or the like on a retention member or retention members engaged to a wall or like surface and a protective cap.

BACKGROUND OF THE INVENTION

The art of hanging a picture, mirror, or the like can be a tedious process. A retention member or retention members must be placed on a wall at a desired height and then the picture, mirror, or the like must be correctly positioned on the retention member. Many pictures and mirrors either contain a hanging wire or hanging hook on the rear of the picture or mirror for positioning the picture or mirror on the retention member. The act of positioning the hanging wire or hanging hook correctly on the retention member can be challenging. Additionally, the act of straightening the picture or mirror while it is engaged to the retention member can be equally challenging.

There is a need for a device that easily allows a user to position the hanging wire or hanging hook of a mirror or picture on a retention member positioned on a wall. There is also a need for a device that easily allows a user to accurately align the picture or mirror on the retention member.

BRIEF SUMMARY OF THE INVENTION

According to an embodiment of the invention, the present invention is a picture hanging device for mounting a picture to a retention member engaged to a wall. The picture hanging device includes a tube having a top portion and a bottom portion, a bottom portion of the tube that is designed to receive a retention member mounted to a wall, and the top portion of the tube contains a cap and extends into the air for correctly aligning the picture on the retention member. The hanging mechanism is engaged to the picture and is positioned around the tube and is slid down the tube for engagement to the retention member and the tube is positioned within the center of the picture for correctly aligning the picture on the retention member.

According to another embodiment of the present invention, the tube is generally cylindrical.

According to yet another embodiment of the present invention, the tube is composed of plastic, polyethylene, or like material with the desired amount of rigidity and flexibility.

According to yet another embodiment of the present invention, the top portion of the tube is cylindrical.

According to yet another embodiment of the present invention, the tube is composed of plastic.

According to yet another embodiment of the present invention, the retention member has an upper portion that is cylindrical for receiving a corresponding cylindrical cap.

According to yet another embodiment of the present invention, the cap includes a generally cylindrical hollow cavity for receiving a correspondingly cylindrical top portion of the tube.

According to yet another embodiment of the present invention, the cap includes a centrally located nipple.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figures 1, 2, 8:
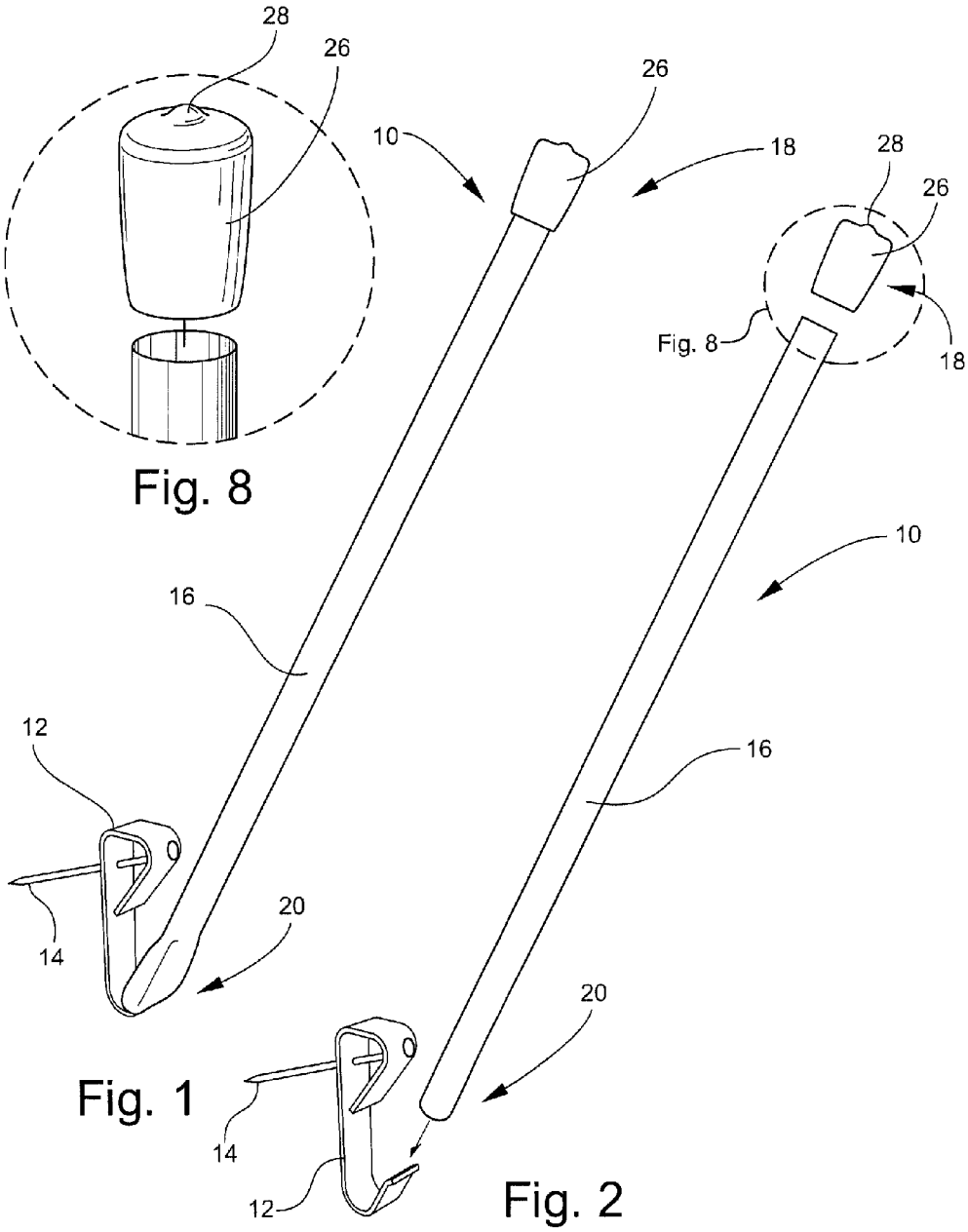
FIG. 1 is a perspective view of the picture hanging device.
FIG. 2 is another perspective view of the picture hanging device.
FIG. 8 is a prospective view of the protective cap of the picture hanging device.
Figure 3:
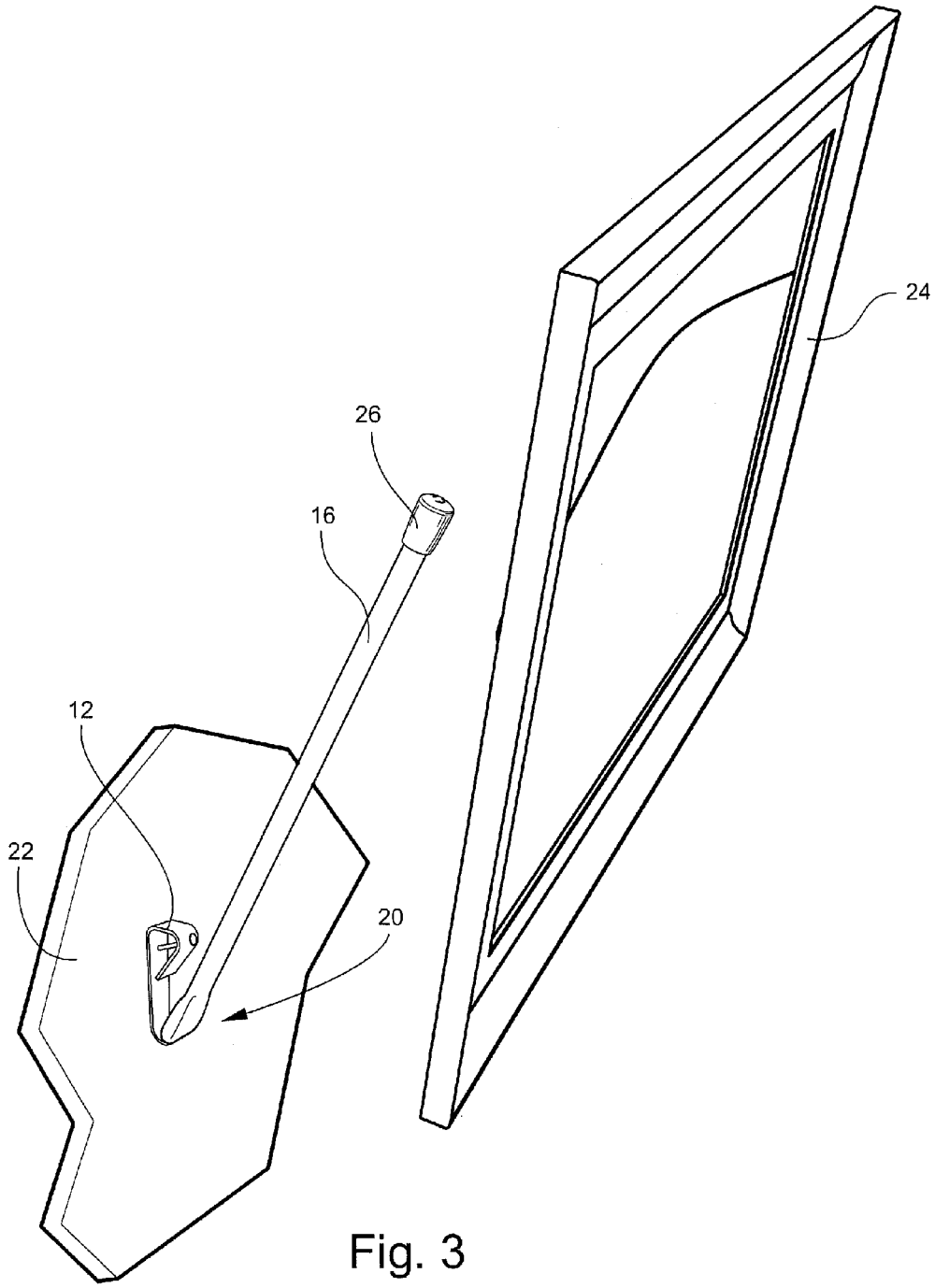
FIG. 3 is a perspective view of the picture hanging device mounted to a wall and a picture about to be installed on the picture hanging device.

Referring now specifically to the drawings, a picture hanging device is illustrated in FIGS. 1 and 2 and is shown generally at reference numeral 10. The device 10 includes a retention member 12, a nail 14, and a tube 16. The tube 16 is a generally cylindrical tube that has a top portion 18 and a bottom portion 20, wherein a cap 26 is engaged to the top portion 18 of the tube 16. The retention member 12 has an upper portion and a lower portion. The lower portion of the retention member 12 is angled upward to receive a hanging mechanism of a picture 24. The upper portion of the retention member 12 is designed to receive the nail 14 and the lower portion of the retention member 12 is designed to receive the bottom portion 20 of the tube 16.

The retention member 12 is designed to be engaged to a wall 22 or other like structure. Preferably, the retention member 12 is a standard picture bracket that is one, solid piece. The upper portion of the retention member 12 is bent in upon itself and has a bore extending therethrough. The bore is designed to receive the nail 14 for engaging the retention member 12 to the wall 22.

In addition to receiving the hanging mechanism of a picture 24, the lower portion of the retention member 12 also receives the bottom portion 20 of the tube 16. When the tube 16 is positioned on the lower portion of the retention member 12, the tube 16 extends upward at an angle. The tube 16 is designed to receive the hanging mechanism of a picture 24 for engaging the hanging mechanism to the lower portion of the retention member 12.

Although the tube 16 is preferably generally cylindrical, it may be any shape as required by the user. It also should be noted that the tube 16 may have any length, width, or diameter that is desired by the user. The tube 16 is preferably straight or planar in the axial direction, but the tube 16 may be curved depending upon the desires of the user. However, it is preferred that the length of the tube 16 is a length that would extend above the top of the picture 24, when the hanging mechanism of the picture 24 is engaged to the lower portion of the retention member 12. Preferably, the tube 16 extends above the top of the picture 24 a length of about 1 inch or more. However, a person of ordinary skill in the art will recognize that the tube 16 can extend any distance above the top of the picture 24 as desired by the user.

The cap 26 is generally cylindrical and contains an inner cylindrical cavity. The cavity is designed to receive the top portion 18 of the tube 16. The cavity has a diameter close or similar to the outer diameter of the tube 16 for receiving the top portion 18 of the tube 16 within the cavity of the cap 26. The cap 26 includes a closed end containing a centrally located nipple 28. The cap 26 is preferably composed of a soft plastic for allowing the cap 26 to be flexible for easy insertion onto the top portion 18 of the tube 16. On the other hand, the cap 26 may be constructed of a rigid plastic, soft plastic, vinyl, polyethylene or a like material for allowing the cap 26 to be flexible. In one embodiment, the cap 26 is selectively secured to the top portion 18 of the tube 16 by friction fit. In an alternative embodiment, the cap 26 is secured to the top portion 18 of the tube 16 by an adhesive or the like.

In an alternative embodiment, the bottom portion of the cap 26 may include a stem extending therefrom. The stem is intended to be inserted into the top portion 18 of the tube 16 for engaging the cap 26 to the tube 16. The stem generally has a diameter slightly smaller than the inner diameter of the tube 16 for receiving the stem into the top portion 18 of the tube 16. In yet another alternative embodiment, the top portion 18 of the tube 26 has a frustoconical or rounded shape or the top portion 18 is not hollow and is closed or a solid top portion 18.

The term hanging mechanism of the picture 24 is generally a term meaning the mechanism or device located on the picture 24 for suspending the picture 24 from the retention member 12. Generally, the hanging mechanism consists of a hook, a wire, a string, a nylon string, or the like that is positioned on the back of the picture 24. It should also be noted that picture may be interchanged with a mirror, or other like structure that a user may desire to hang from the wall 22 or other support structure.

Figure 7:
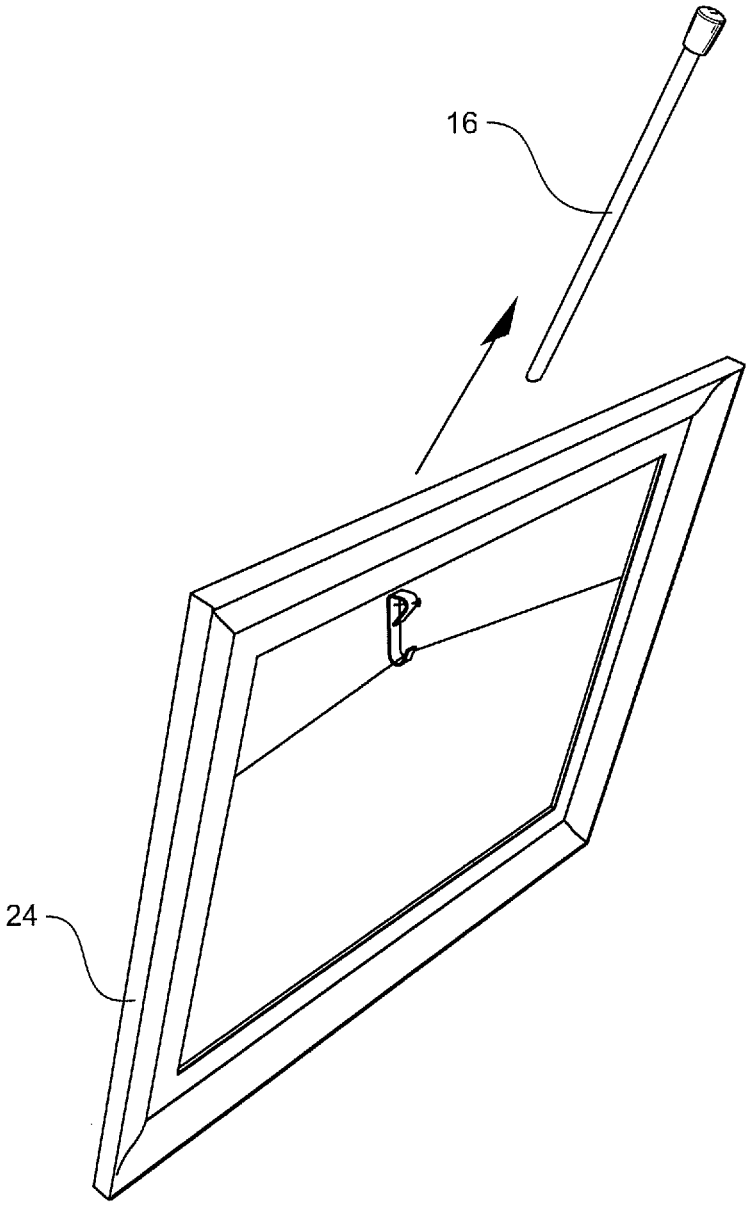
FIG. 7 is a perspective view of the tube being removed from the retention member of the picture hanging device.

As illustrated in FIG. 7, the top portion 18 of the tube 16 is generally cylindrical. In other words, the top portion 18 is cylindrical. In one embodiment, the tube 16 has a constant inner and outer circumference along the length of the tube 16. However, one of ordinary skill in the art will recognize that the inner and outer circumference of the tube 16 may have differing or varying inner and outer circumferences based upon the desires of the user. The circumference of the tube 16 may have a differing or varying inner and outer circumference based upon the desires of the user to fit the retention member 12.

During use, the retention member 12 is engaged to the wall 22 with the nail 14, as illustrated in FIGS. 3, 4, 5, and 6. The bottom portion 20 of the tube 16 is engaged to the lower portion of the retention member 12. Preferably, the tube 16 is hollow and the lower portion of the retention member 12 is inserted into the bottom portion 20 of the tube 16 and is retained therein by friction fit. In another embodiment, the lower portion of the tube 16 may have a generally rectangular or generally square shape that mirrors the shape of the lower portion of the retention member 12.

Figure 4:
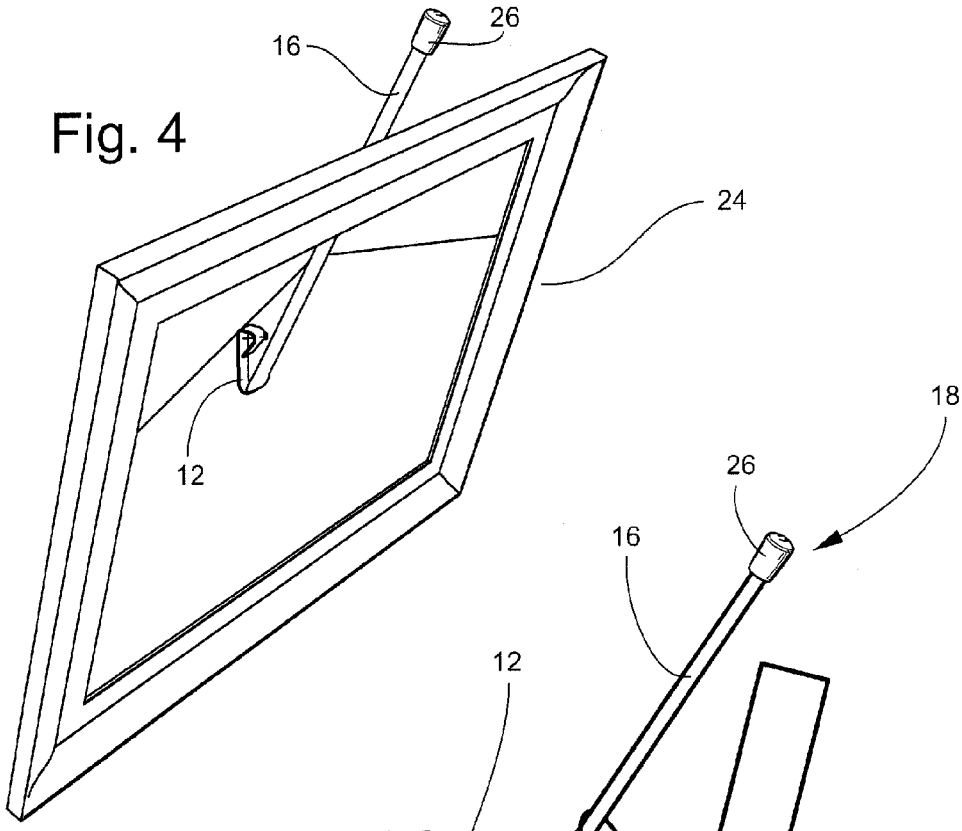
FIG. 4 is a perspective view of a picture inserted on the picture hanging device.
Figure 5:
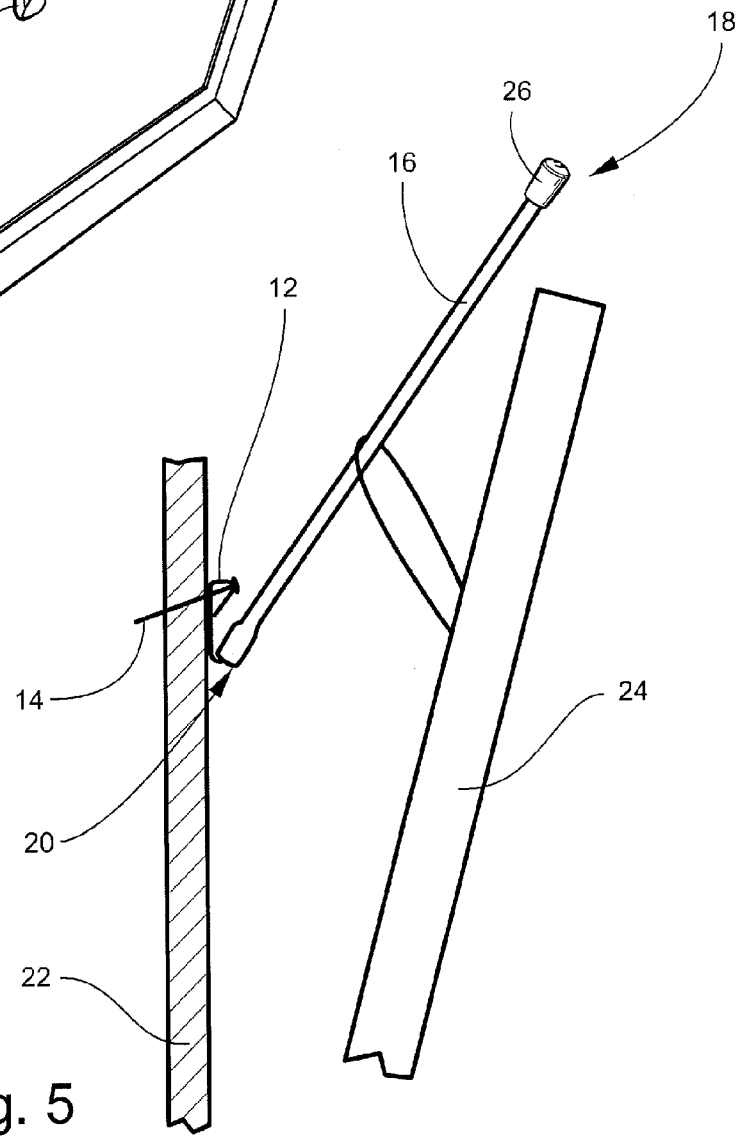
FIG. 5 is a side view of a picture inserted on the picture hanging device.
Figure 6:
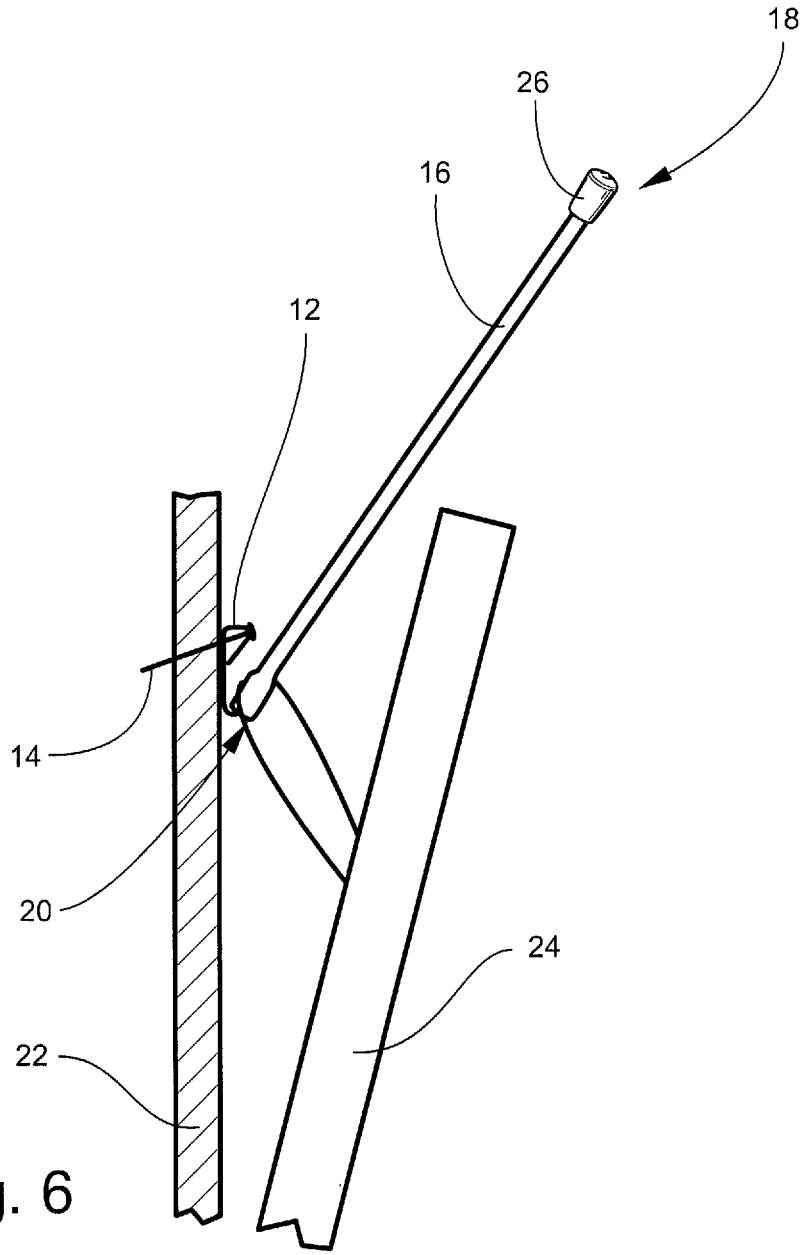
FIG. 6 is a side view of the picture hanging mechanism engaged to the retention member with the assistance of the picture hanging device with protective cap.

The hanging mechanism of the picture 24 is positioned over or around the tube 16, as illustrated in FIGS. 4, 5, and 6. In other words, the tube 16 is positioned between the hanging mechanism and the picture 24 with the hanging mechanism positioned around the tube 16 when the hanging mechanism is a wire or the like. If the hanging mechanism is a hook or the like, the tube 16 is positioned within the hook with the hook around the tube 16. The hanging mechanism and picture 24 is slid down the tube, until the hanging mechanism is engaged to the lower portion of the retention member 12. A user will be able to determine whether the tube 16 is positioned between the hanging mechanism and the picture (or within the hanging mechanism should the hanging mechanism be a hook or the like) by moving the picture 24 towards and away from the wall 22 because the tube 16 will move in conjunction with the picture 24. When the hanging mechanism is engaged to the retention member 12, the tube 16 extends above the picture 24, as shown in FIGS. 4, 5, and 6.

Once the hanging mechanism is engaged to the retention member 12, the user may utilize a measuring tape to determine the center portion of the picture 24. This center portion may be marked utilizing a pencil, tape, or another marking device or mechanism that can be removed easily from the picture 24 without leaving a mark. The picture 24 can be moved to the left or right to ensure the center of the picture 24 is aligned with the tube 16. The tube 16 may also include an indicator or mark that indicates the center of the tube 16 for enabling the user to position the center of the picture 24 with the center of the tube 16. The cap 26 may also include an indicator or mark that indicates the center of the cap 26 in the form of the nipple 28 or other mark. When the cap 26 is fitted on top of the tube 16, the center of the cap 26 becomes the center of the extended tube 16. Further, the user may apply a level to ensure the picture is hanging level. Afterwards, the tube 16 is disengaged from the retention member 12 by pulling the tube 16 upwards, as illustrated in FIG. 6.

The retention member 12 may also be a self-adhering plastic bracket, such as the Command™ line of brackets or hooks from the 3M Corporation. The retention member 12 may also be a cloth bracket, a nail, or the like. The retention member 12 may be anything that is engaged to a wall that receives a picture or mirror and holds the picture or mirror on the wall. The retention member 12 may be a standard picture hanging bracket that one of ordinary skill in the art would understand and purchase. In another embodiment, the retention member 12 is a metal picture bracket as illustrated in FIGS. 1 and 2.

A kit of goods is disclosed herein. The kit may include a retention member 12, a nail 14, and a tube 16, including a cap 26, for accurately and efficiently hanging a picture 24. Alternatively, the kit may include a retention member 12, a nail 14, a tube 16, and a cap 26 for placement on the tube 16 by the user. The kit may be situated in a bag, box or other suitable packaging for retaining the items in the kit. The kit may also include a hanger, a bore or the like for hanging the kit on a display shelf. Additionally, the kit may include a hanging mechanism, such as a wire, hook, eye hook, string, nylon string, a nail, at least two nails, a plurality of nails, or the like that would be utilized to hang a picture 24, mirror or the like. The kit may also include more than one retention member 12, more than one nail 14, more than one cap 26, and more than one tube 16. The kit may also include varying sizes of retention members 12, nails 14, caps 26, and tubes 16. The kit may also include a set of instructions for using the picture hanging device 10.

It will be known by one of ordinary skill in the art to have a tube 16 of multiple sizes and dimensions, depending upon the uses by the user. The tube 16 may be composed of plastic, but could also be composed of a material other than plastic, such as nylon, vinyl, polyethylene, rubber, paper product, plastic composites or the like, that has similar rigidity and/or flexibility, is light weight, and has similar durability as plastic.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A picture hanging device for mounting a picture to a retention member engaged to a wall, comprising:

a tube having a top portion and a bottom portion;

the bottom portion of the tube is designed to receive a retention member mounted to a wall;

the top portion of the tube extends into the air for correctly aligning the picture on the retention member;

a cap engaged to the top portion of the tube; and whereby a hanging mechanism engaged to the picture is positioned around the tube and is slid down the tube for engagement to the retention member and the tube is positioned within the center of the top edge of the picture for correctly aligning the picture on the retention member.

2. The picture hanging device of claim 1, wherein the tube is generally cylindrical.

3. The picture hanging device of claim 1, wherein the top portion of the tube is generally cylindrical.

4. The picture hanging device of claim 1, wherein the top portion of the tube is generally cylindrical and the cap includes a generally cylindrical cavity for receiving the top portion of the tube.

5. The picture hanging device of claim 1, wherein the tube and cap are composed of a material selected from the group consisting of plastic, vinyl and polyethylene.

6. The picture hanging device of claim 1, wherein the retention member has an upper portion that is bent in upon itself and has a bore extending therethrough.

7. The picture hanging device of claim 1, wherein the tube is generally cylindrical.

8. The picture hanging device of claim 1, wherein the top portion of the tube is generally cylindrical for receiving the generally cylindrical cap.

9. The picture hanging device of claim 1, wherein the cap includes a generally cylindrical cavity and a closed end containing a nipple.

10. The picture hanging device of claim 1, wherein the tube and cap are composed of a material selected from the group consisting of plastic, vinyl, and polyethylene.

11. The picture hanging device of claim 1, wherein the retention member has an upper portion that is bent in upon itself and has a bore extending therethrough.

12. The picture hanging device of claim 1, wherein the tube is generally cylindrical with a constant diameter from the top portion to the bottom portion.

13. The picture hanging device of claim 1, wherein the cap is generally flexible.

14. The picture hanging device of claim 1, wherein the cap contains a raised nipple.

15. The picture hanging device of claim 1, wherein the tube and cap are composed of a material selected from the group consisting of plastic, vinyl, and polyethylene.

16. The picture hanging device of claim 1, wherein the retention member has an upper portion that is bent in upon itself and has a bore extending therethrough.

17. A picture hanging device for mounting a picture to a retention member engaged to a wall, comprising:

a generally cylindrical tube that has a constant diameter along the length of the tube, having a top portion and a bottom portion;

the bottom portion of the tube is designed to receive a retention member mounted to a wall;

the top portion of the tube extends into the air for correctly aligning the picture on the retention member;

a generally cylindrical cap engaged to the top portion of the tube; and whereby a hanging mechanism engaged to the picture is positioned around the tube and is slid down the tube for engagement to the retention member and the tube is positioned within the center of the top edge of the picture for correctly aligning the picture on the retention member.

18. A picture hanging device for mounting a picture to a retention member engaged to a wall, comprising:

a generally cylindrical tube having a top portion and a bottom portion;

the bottom portion of the tube is designed to receive a retention member mounted to a wall;

the top portion of the tube extends into the air for correctly aligning the picture on the retention member;

a cap having a generally cylindrical cavity for receiving the top portion of the tube; and whereby a hanging mechanism engaged to the picture is positioned around the tube and is slid down the tube for engagement to the retention member and the tube is positioned within the center of the top edge of the picture for correctly aligning the picture on the retention member.

* * * * *